US007479887B2

(12) United States Patent
Meyer

(10) Patent No.: US 7,479,887 B2
(45) Date of Patent: Jan. 20, 2009

(54) CLOSURE AND CONTAINER PACKAGE WITH RFID CIRCUIT

(75) Inventor: Todd W. Meyer, Ottawa, OH (US)

(73) Assignee: Rexam Healthcare Packaging Inc., Perrysburg, OH (US)

( * ) Notice: Subject to any disclaimer, the term of this patent is extended or adjusted under 35 U.S.C. 154(b) by 324 days.

(21) Appl. No.: 11/517,000

(22) Filed: Sep. 7, 2006

(65) Prior Publication Data

US 2008/0068179 A1 Mar. 20, 2008

(51) Int. Cl.
*G08B 13/14* (2006.01)

(52) U.S. Cl. ..... 340/572.8; 340/572.7; 340/572.1; 340/571; 340/572.3; 340/572.4; 340/572.9

(58) Field of Classification Search ..... 340/571, 340/572.1, 572.3, 572.4, 572.8, 539.1
See application file for complete search history.

(56) References Cited

U.S. PATENT DOCUMENTS

| | | | | |
|---|---|---|---|---|
| 4,813,564 | A * | 3/1989 | Cooper et al. | 215/366 |
| 5,646,592 | A * | 7/1997 | Tuttle | 340/545.6 |
| 6,137,413 | A * | 10/2000 | Ryan, Jr. | 340/572.8 |
| 6,641,052 | B2 | 11/2003 | Baillod et al. | |
| 6,782,601 | B2 | 8/2004 | Smeyak et al. | |
| 6,859,745 | B2 | 2/2005 | Carr et al. | |
| 7,017,807 | B2 * | 3/2006 | Kipp et al. | 235/385 |
| 7,098,794 | B2 * | 8/2006 | Lindsay et al. | 340/572.3 |
| 7,176,796 | B2 * | 2/2007 | Chen et al. | 340/568.1 |
| 7,364,089 | B2 * | 4/2008 | Claessens et al. | 235/492 |
| 7,382,262 | B2 * | 6/2008 | Commagnac et al. | 340/572.1 |
| 7,388,506 | B2 * | 6/2008 | Abbott | 340/572.8 |
| 2002/0183883 | A1 | 12/2002 | Carr et al. | |
| 2003/0061705 | A1 | 4/2003 | Smeyak et al. | |
| 2003/0061706 | A1 | 4/2003 | Smeyak et al. | |
| 2003/0099158 | A1 * | 5/2003 | De la Huerga | 368/10 |
| 2003/0235027 | A1 | 12/2003 | Smeyak et al. | |
| 2005/0068182 | A1 | 3/2005 | Dunlap et al. | |
| 2005/0128087 | A1 | 6/2005 | Claessens et al. | |
| 2005/0162277 | A1 * | 7/2005 | Teplitxky et al. | 340/572.8 |
| 2005/0255261 | A1 | 11/2005 | Nomula | |
| 2006/0049948 | A1 * | 3/2006 | Chen et al. | 340/572.7 |
| 2007/0296599 | A1 * | 12/2007 | Wang et al. | 340/572.8 |

FOREIGN PATENT DOCUMENTS

| | | |
|---|---|---|
| DE | 20105605 | 6/2001 |
| EP | 0615285 | 9/1994 |
| WO | WO 2005/024745 | 3/2005 |
| WO | WO 2005/040001 | 5/2005 |

* cited by examiner

*Primary Examiner*—George A Bugg
*Assistant Examiner*—Son M Tang
(74) *Attorney, Agent, or Firm*—Reising, Ethington, Barnes, Kisselle, P.C.

(57) ABSTRACT

A tamper-indicating closure includes a closure shell having a skirt for securing the closure to a container neck finish and a tamper band frangibly coupled to the skirt for separation from the skirt upon first removal of the closure from the container. An RFID circuit, including an RFID tag and an antenna, is carried by the tamper band for separation from the skirt with the tamper band and remaining operational on the container after the closure has been removed from the container. The RFID circuit preferably is carried by a stop flange that extends from the tamper band, and is disposed between the stop flange and the tamper band.

9 Claims, 1 Drawing Sheet

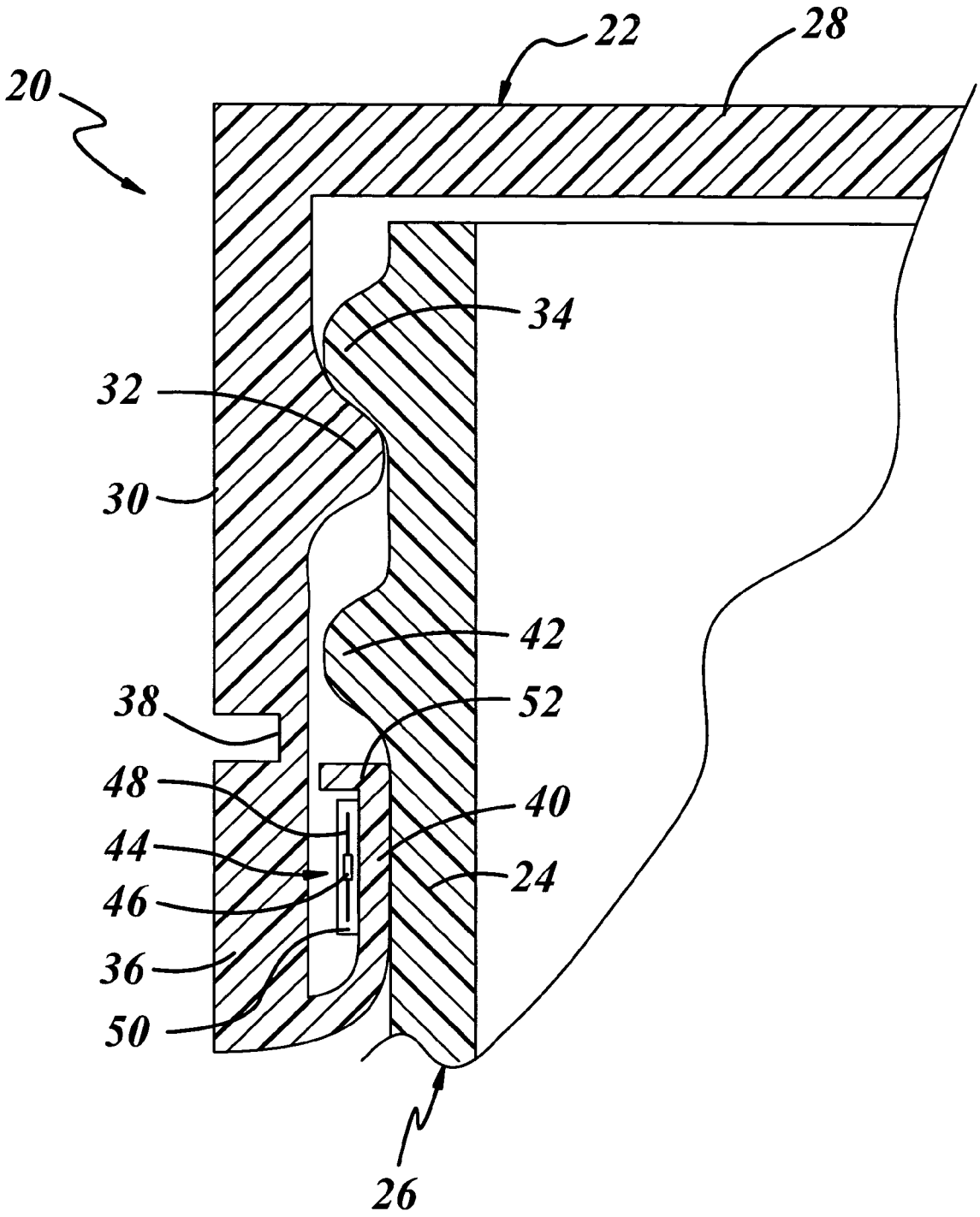
20
22
28
34
32
30
42
38
52
48
40
44
24
46
36
50
26

CLOSURE AND CONTAINER PACKAGE WITH RFID CIRCUIT

The present disclosure relates to placement of a radio frequency identification (RFID) circuit on a closure and container package for identification or other purposes, and to a closure for such a package.

BACKGROUND AND SUMMARY OF THE DISCLOSURE

A general object of the present disclosure is to provide a package that includes a closure, a container and an RFID circuit that remains with the container after the closure has been removed from the container.

The present disclosure embodies a number of aspects that can be implemented separately from or in combination with each other.

A tamper-indicating closure in accordance with one aspect of the present disclosure includes a closure shell having a skirt for securing the closure to a container neck finish and a tamper band frangibly coupled to the skirt for separation from the skirt upon first removal of the closure from the container. An RFID circuit, including an RFID tag and an antenna, is carried by the tamper band for separation from the skirt with the tamper band and remaining operational on the container after the closure has been removed from the container. The RFID circuit preferably is carried by a stop flange that extends from the tamper band, and is disposed between the stop flange and the tamper band.

BRIEF DESCRIPTION OF THE DRAWINGS

The disclosure, together with additional objects, features, advantages and aspects thereof, will best be understood from the following description, the appended claims and the accompanying drawing, which is a fragmentary sectional view of a package in accordance with an exemplary embodiment of the present disclosure.

DETAILED DESCRIPTION OF PREFERRED EMBODIMENTS

The drawing illustrates a package 20 in accordance with an exemplary embodiment of the present disclosure. Package 20 includes a closure 22 applied to the neck finish 24 of a container 26. Container 26 may be of glass or plastic construction. Closure 22 preferably is of molded plastic construction and includes a shell having a base wall 28 and a skirt 30 with one or more internal thread segments 32 for engagement with one or more external thread segments 34 on neck finish 24 to secure closure 22 to container 26. (The term "thread segments" is employed in its usual broad sense to include both continuous and discontinuous threads, and both single and multiple threads on the container neck finish.) Skirt 30 includes a tamper band 36 frangibly connected by one or more frangible bridges or webs 38. Tamper band 36 may be of any suitable geometry, with the geometry illustrated in the drawing being exemplary. In this exemplary geometry, a stop flange 40 preferably extends upwardly and inwardly from tamper band 36 for engagement with an external bead 42 on container neck finish 24. Stop flange 40 typically is molded in an orientation extending axially and angularly away from base wall 28, and is "inverted" in a post-molding operation to an orientation extending axially and radially toward base wall 28. When closure 22 is first removed from neck finish 24, abutment of stop flange 40 with bead 42 limits movement of band 36 so that band 36 becomes separated from skirt 30 by fracture of bridges or webs 38 to provide an indication that the package has been opened. Closure 22 may include additional elements, such as one or more sealing elements, either integral with or separate from the closure shell, for sealing engagement with the container neck finish.

An RFID circuit 44 is provided on package 20. Circuit 44 in the exemplary embodiment includes an RFID tag 46 and an antenna 48 coupled to tag 46 so that tag 46 can be interrogated through antenna 48 by external interrogation circuitry. RFID circuit 44 preferably is carried by stop flange 40 between stop flange 40 and tamper band 36. RFID circuit 44 preferably is mounted on or encapsulated in a suitable substrate 50 that is molded into or mounted on the surface of stop flange 40, such as by a suitable adhesive prior to inversion of stop flange 40 to the orientation illustrated in the drawing. RFID circuit 44 thus is protected between stop flange 40 and tamper band 36. Stop flange 40 preferably includes an end lip 52 that extends toward tamper band 36 in assembly for additional enclosing protection of RFID circuit 44.

When closure 22 is initially applied to neck finish 24 (after placement of product within container 26), stop flange 40 and tamper band 36 expand outwardly during travel over bead 42 on neck finish 24. RFID circuit 44 can be interrogated for identification or other purposes, such as for pricing purposes when purchasing package 20. When closure 22 is first removed from container neck finish 24, abutment of stop flange 40 with bead 42 applies forces to bridges or webs 38 that fracture the bridges or webs so that tamper band 36 remains on container neck finish 24 after the closure has been removed. RFID circuit 44 remains operational after removal of closure 22, and remains operational even if closure 22 is reapplied to the container neck finish. Thus, RFID circuit 44 provides for identification of the package, but does not indicate that the package has been opened.

There thus have been disclosed a package and a closure that fully satisfy all of the objects and aims previously set forth. The disclosure has been presented in connection with an exemplary embodiment, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A tamper-indicating closure that includes:

a closure shell having a skirt for securing the closure to a container neck finish and a tamper band frangibly coupled to said skirt for separation from said skirt upon first removal of the closure from a container, and an RFID circuit, including an RFID tag and an antenna, carried by said tamper band for separation from said skirt with said tamper band and remaining operational on the container after the closure is removed from the container, wherein said tamper band includes a stop flange extending from said tamper band to be positioned between said tamper band and container neck finish and said RFID circuit is carried between said tamper band and said stop flange.

2. The closure set forth in claim 1 wherein said RFID circuit is carried by said stop flange.

3. The closure set forth in claim 2 wherein said shell is of molded plastic construction.

4. The closure set forth in claim 3 wherein said stop flange has a lip extending toward said tamper band and enclosing said RFID circuit.

5. The closure set forth in claim 3 wherein said RFID circuit is on a substrate that is molded into or adhered to said stop flange.

6. A package that includes:

a container having a neck finish with at least one external thread segment and an external bead, and a closure having a skirt with at least one internal thread segment for engaging said at least one external thread segment on said neck finish to secure said closure to said neck finish, a tamper band frangibly extending from said skirt for engagement with said external bead to separate said tamper band from said skirt upon first removal of said closure from said neck finish, and an RFID circuit, including an RFID tag and antenna, carried by said tamper band for separation from said skirt with said tamper band and remaining operational on said container after said closure is removed from said container, wherein said tamper band includes a stop flange extending from said tamper band to be positioned between said tamper band and the container neck finish and said RFID circuit is carried between said tamper band and said stop flange.

7. The package set forth in claim 6 wherein said RFID circuit is carried by said stop flange.

8. The package set forth in claim 6 wherein said stop flange has a lip extending toward said tamper band and enclosing said RFID circuit.

9. The package set forth in claim 6 wherein said closure is of molded plastic construction, and said RFID circuit is on a substrate that is molded into or mounted on said stop flange.

* * * * *